United States Patent [19]

Hudson

[11] 4,284,386

[45] Aug. 18, 1981

[54] HIGH PRESSURE PUMP

[76] Inventor: James L. Hudson, 2601 S. Forest Dr., Melbourne, Fla. 32901

[21] Appl. No.: 33,566

[22] Filed: Apr. 27, 1979

[51] Int. Cl.[3] ..... F04D 29/54

[52] U.S. Cl. ..... 415/209; 415/11

[58] Field of Search ..... 415/11, 92, 209; 366/263, 265, 302, 307, 311

[56] References Cited

U.S. PATENT DOCUMENTS

| | | | |
|---|---|---|---|
| 640,345 | 1/1900 | Wilberforce | 415/209 |
| 1,403,103 | 1/1922 | Petrie | 415/92 |
| 2,117,011 | 5/1938 | Pratt | 415/209 |
| 3,225,539 | 12/1965 | Coverston | 60/39.44 |

*Primary Examiner*—Harvey C. Hornsby

*Assistant Examiner*—Timothy F. Simone

*Attorney, Agent, or Firm*—Bailey, Dority & Flint

[57] ABSTRACT

A high pressure pump including a cylindrical rotor carried within a cylindrical cavity provided in a housing. Inlet and outlet ports are provided for transporting fluid to and from the cavity. A plurality of circumferentially spaced concave semicircular chambers are provided on the periphery of the rotor. A pivotal member is carried closely adjacent the outlet port and rides along the curving wall of the chambers as the chambers pass the outlet port directing fluid transported in the chambers to the outlet port. The rotor is driven by an electric motor. A bypass valve is provided between the outlet and inlet ports for bypassing the flow of fluid therebetween when an obstruction appears in the outlet or when the pressure exceeds a predetermined value.

5 Claims, 3 Drawing Figures

HIGH PRESSURE PUMP

BACKGROUND OF THE INVENTION

Centrifugal pumps such as disclosed in U.S. Pat. No. 2,117,011 are provided for increasing the pressure of fluids by driving vanes carried on a rotor within a housing. As water is fed to cavities provided between adjacent vanes on the rotor, the fluid is transported to an outlet port. One problem with such pumps is that some of the fluid carried between the adjacent vanes is not discharged out of the outlet port as that particular chamber passes the outlet port affecting the efficiency of the pump. Similar centrifugal pumps are disclosed in U.S. Pat. Nos. 640,345 and 2,724,338.

SUMMARY OF THE INVENTION

A pressure pump comprising a casing having a cylindrical cavity provided therein with an inlet port extending through the casing into the cavity and an outlet port carried on the other side of the rotor from the inlet port for removing fluid from the pump under pressure. The cylindrical rotor has a plurality of circumferentially spaced concave curving walls provided on the periphery thereof defining semicircular chambers.

A pivotal member is carried adjacent the outlet port and is provided for scooping the fluid out of the respective chambers as the chambers are rotated past the outlet port. The pivotal member is spring biased so that an inwardly extending arm rides on the curving walls of the chambers as the chambers pass the outlet port.

Any suitable means may be used for driving the rotor and in one particular embodiment, an electric motor of approximately one-fourth horsepower is used for driving the rotor at approximately 1750 rpm. A bypass valve is provided between the outlet port and the inlet port for bypassing the fluid from the outlet port when it exceeds a predetermined pressure such as set by a bypass valve or when an obstruction appears in the outlet port.

Accordingly, it is an important object of the present invention to provide a very simple and efficient high pressure pump.

Another important object of the present invention is to provide a reliable pump having a minimum of moving parts for delivering fluid such as water, from either a pressurized source or a nonpressurized source to the outlet at a high pressure and rate of flow.

The construction designed to carry out the invention will be hereinafter described, together with other features thereof.

The invention will be more readily understood from a reading of the following specification and by reference to the accompanying drawing forming a part thereof, wherein an example of the invention is shown and wherein:

DESCRIPTION OF A PREFERRED EMBODIMENT

Figure 1:
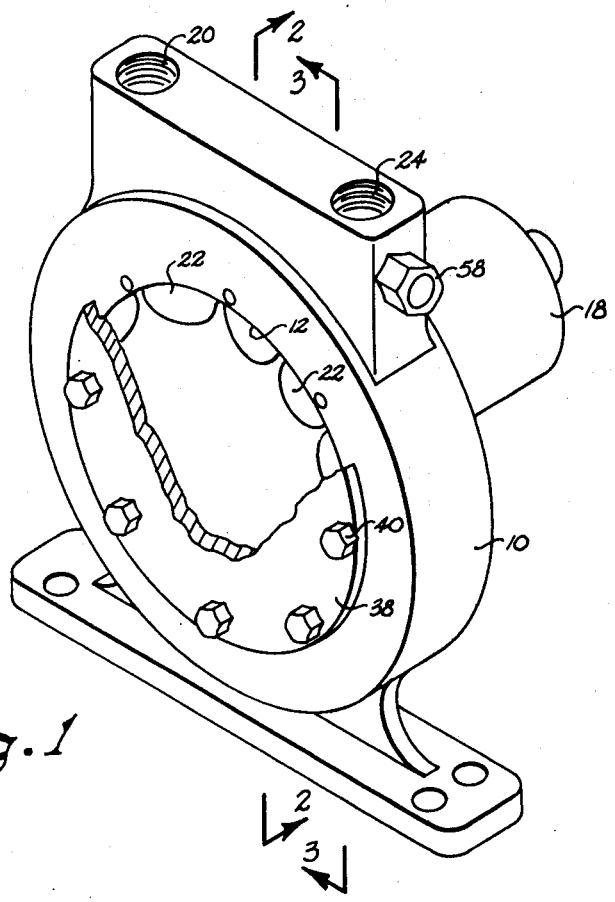
FIG. 1 is a perspective view with parts cut away for purposes of clarity, illustrating a high pressure pump constructed in accordance with the present invention.

Referring to FIG. 1 of the drawing, there is illustrated a pump which is designed to deliver a high pressure stream of fluid with the approximate viscosity of water from either a pressurized source or a nonpressurized source. The pump includes a cylindrical housing 10 which has a cylindrical cavity 12 provided therein. A cylindrical rotor 14 is carried within the cavity 12 and is keyed to a shaft 16 that may be the output shaft of an electric motor 18. In one particular embodiment, the electric motor 18 is a one-quarter horsepower motor that operates at 1750 rpm. Of course, it is to be understood that any suitable drive for the rotor could be utilized. A plurality of circumferentially spaced arcuate walls are provided on the periphery of the rotor and define semicircular chambers 22.

Figure 2:
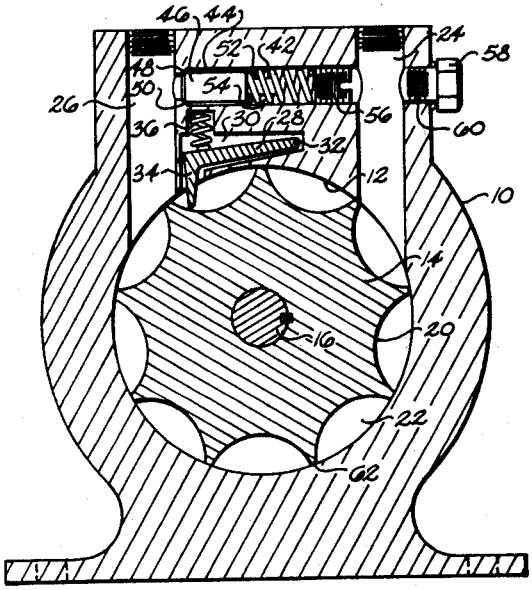
FIG. 2 is a sectional view taken along line 2—2 of FIG. 1.
Figure 3:
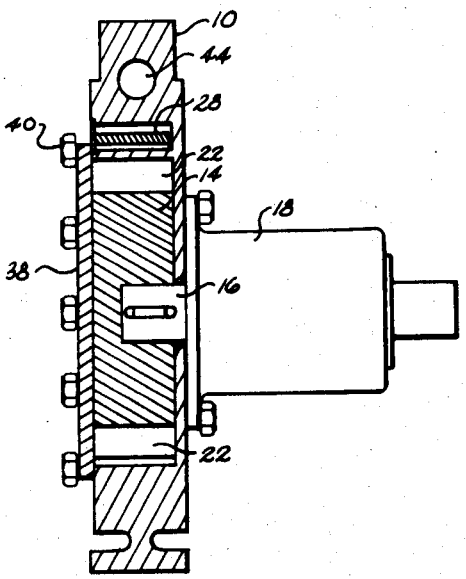
FIG. 3 is a sectional view taken along line 3—3 of FIG. 1.

An inlet port 24 extends through the housing 10 and communicates with the cavity 12. An outlet port 26 communicates with the cavity 12 and extends through the housing 10 on the other side of the longitudinal axis of the rotor, as best shown in FIG. 2. The ends of the inlet port and outlet port have internal threads provided therein to which tubes or couplings can be connected for delivering fluid to the inlet port 24 and from the exit port 26.

A pivotal member 28 is provided in a recess 30 in the interior of the casing adjacent the cavity 12 and takes the shape of an L-shaped member. One end of the L-shaped member is pivotally connected to the casing by means of a pin 32. An inwardly extending arm 34 is provided on other end of the L-shaped member and projects through an opening in the casing. The arm 34 extends into the cavity and rides on the curved walls of the chambers 20. A spring 36 presses against the other side of the L-shaped member for maintaining the lower end of the member 34 in contact with the curving walls as the rotor is rotated. The cavity is sealed by a side plate 38 that is secured to the side of the housing by means of bolts 40.

A passage 42 extends between the outlet port 26 and the inlet port 24 and is provided for receiving a pressure relief valve, generally designated by the reference character 44. The pressure release valve includes a reciprocal plunger 46 that has its left-hand end beveled as at 48 which seats against a complimentary angled surface 50 provided in the left-hand end of the bore.

The right-hand end of the plunger 44 has a reduced diameter 52 upon which an end of a compression spring 54 is received. The other end of the compression spring 54 bears against the inner end of a hollow plug 56. The plug 56 is threaded in the right-hand end of the bore 44. By rotating the hollow plug 56 the amount of pressure applied by the spring 54 onto the plunger 46 can be varied. As a result, the pressure required by fluid flowing out of the outlet port to unseat the plunger for allowing the fluid to be recirculated back through the port 44, can be varied.

A large headed bolt 58 is threaded in a bore 60 provided in the wall of the casing directly in alignment with the adjusting plug 56 so as to permit access to the adjusting plug 56 by means of a screwdriver or the like, and also to provide access to the bore 44 in order to insert the pressure relieving assembly therein.

It is noted that the outer extremeties 62 of the curving walls run closely adjacent the inner walls of the cavity 12.

In operation, a source of fluid is coupled to the inlet port 24 which may be either from a pressurized source or a nonpressurized source. When the motor 18 is energized it causes the rotor 14 to rotate drawing fluid through inlet port 24 into the chambers 22. As the chambers 22 pass the inlet port, the chambers are filled with fluid and transported around in a clockwise direction to the outlet port 26. The inwardly extending arm 34 rides along the curving inner wall of the chambers directing the fluid carried in the chambers out the exit port. Since the inner walls of the chambers are semicircular in shape such causes the pivotal member 28 to pivot up and down about the pivot point 32 during operation. If for some reason the outlet port is closed while the pump is running, then the pressure at the outlet port overcomes the force applied by the compression spring 54 against the plunger 46 allowing the water or liquid to flow back through the passage 42 to the inlet port of the pump.

While the pivotal member has been illustrated as a substantially L-shaped member, it is to be understood that other types of devices such as rocker arms which ride on the inner walls of the chambers, may be used for directing the fluid out the outlet port.

While a preferred embodiment of the invention has been described using specific terms, such description is for illustrative purposes only, and it is to be understood that changes and variations may be made without departing from the spirit or scope of the following claims.

What is claimed is:

1. A pump comprising:

a casing having a cylindrical cavity provided therein;

a cylindrical rotor carried in said cylindrical cavity;

an inlet port extending through said casing into said cavity positioned on one side of a longitudinal axis of said rotor;

an outlet port extending through said casing into said cavity positioned on an opposite side of said longitudinal axis of said rotor;

means for rotating said rotor;

a plurality of circumferentially spaced concave curving walls provided on the periphery of said cylindrical rotor defining circumferentially spaced chambers;

a source of fluid being supplied through said inlet port into said chambers of said rotor as said rotor is rotated;

a pivotal member carried between said inlet port and said outlet port; and an inwardly extending arm means carried by said pivotal member riding on said curving walls of said chambers as said chambers are rotated past said outlet port directing said fluid from said chambers out said outlet port.

2. The pump as set forth in claim 1 further comprising:

means for resiliently biasing said pivotally supported member so that said arm means is maintained in surface contact with the curved walls of said chambers as said respective chambers are rotated past said outlet port.

3. The pump as set forth in claim 1 further comprising:

said means for rotating said rotor including an electric motor.

4. The pump as set forth in claim 1 further comprising:

outer extremeties of said spaced concaved curving walls being closely adjacent an inner cylindrical wall of said casing defining said cylindrical cavity so that as said rotor is rotated said fluid is carried in said chambers from said inlet port to said outlet port.

5. The pump as set forth in claim 1 further comprising:

said circumferentially spaced chambers being semicircular in shape with an open side facing away from the axis of said rotor.

* * * * *